US011497257B2

(12) United States Patent
Curtiss

(10) Patent No.: US 11,497,257 B2
(45) Date of Patent: Nov. 15, 2022

(54) CHILDREN'S GARMENT

(71) Applicant: Jonell Curtiss, Waldo, WI (US)

(72) Inventor: Jonell Curtiss, Waldo, WI (US)

( * ) Notice: Subject to any disclaimer, the term of this patent is extended or adjusted under 35 U.S.C. 154(b) by 286 days.

(21) Appl. No.: 16/798,798

(22) Filed: Feb. 24, 2020

(65) Prior Publication Data

US 2020/0268067 A1 Aug. 27, 2020

Related U.S. Application Data

(60) Provisional application No. 62/811,064, filed on Feb. 27, 2019.

(51) Int. Cl.

| | |
|---|---|
| ***A41D 11/00*** | (2006.01) |
| ***A44B 19/26*** | (2006.01) |
| ***A41F 1/00*** | (2006.01) |

(52) U.S. Cl.

CPC ..... *A41D 11/00* (2013.01); *A41F 1/008* (2013.01); *A44B 19/26* (2013.01); *A41B 2300/322* (2013.01)

(58) Field of Classification Search

CPC . A41B 13/005; A41B 13/06; A41B 2300/322; A41B 2300/30; A41B 2400/44; A41B 7/02; A41D 10/00; A44B 19/301

See application file for complete search history.

(56) References Cited

U.S. PATENT DOCUMENTS

| | | | | | |
|---|---|---|---|---|---|
| 2,242,130 | A | * | 5/1941 | Hutchison | A47G 9/066 2/69.5 |
| 2,269,632 | A | * | 1/1942 | Markowitz | A41B 7/02 2/270 |
| 2,374,299 | A | * | 4/1945 | O'Hara | A41B 13/06 5/413 R |
| 2,579,276 | A | * | 12/1951 | Schworm, Jr. | A41B 13/06 24/387 |
| 2,663,873 | A | * | 12/1953 | Stern | A41B 13/005 D2/744 |
| 2,680,849 | A | * | 6/1954 | Munro | A41B 13/00 2/69.5 |
| 2,888,009 | A | * | 5/1959 | Taylor | A47G 9/083 5/413 R |
| 2,905,944 | A | * | 9/1959 | Stuart | A41D 10/00 2/269 |

(Continued)

*Primary Examiner* — Jillian K Pierorazio
(74) *Attorney, Agent, or Firm* — Mark P. Stone

(57) ABSTRACT

A garment, preferably a garment for infants, toddlers and children, includes a zipper for securing the wearer within the garment. A locking device is provided for securing the zipper in a closed position when the wearer is received within the garment. The locking device has a retaining element for preventing movement of the zipper slider once it has reached its fully closed position, and a first closure element for enclosing the zipper and the retaining element. The locking device protects the and maintains the zipper in its fully closed position in two separate ways, namely, by retaining element preventing movement of the zipper from its fully closed position, and by the closure element which prevents access to the zipper and the retaining element when the zipper is in its fully closed position. Preferably, the zipper and the locking device are provided at a position on the garment which further prevents access to the zipper and locking device by the wearer.

5 Claims, 4 Drawing Sheets

(56) References Cited

U.S. PATENT DOCUMENTS 2,915,758 A * 12/1959 Jeromes ..... A41B 13/005 2/69.5
5,911,312 A 6/1999 Holyfield
7,305,717 B1 * 12/2007 Brown ..... A41D 13/1272 2/269
7,827,619 B1 * 11/2010 Steinberg ..... A41D 11/00 2/114
8,701,214 B2 4/2014 Stoneham
2005/0102729 A1 * 5/2005 Snedeker ..... A41D 13/0002 2/96
2005/0120459 A1 * 6/2005 McConnell ..... G01K 13/20 374/E13.002
2006/0236441 A1 * 10/2006 Johnson ..... A41B 13/06 2/69.5
2009/0064390 A1 * 3/2009 Beiring ..... A41B 13/06 2/243.1
2009/0222968 A1 * 9/2009 Pisano-Ginter ..... A41B 13/005 2/83
2009/0293169 A1 * 12/2009 Wise ..... A41D 10/00 2/243.1
2010/0218299 A1 * 9/2010 Damir ..... A41B 13/06 2/69.5
2011/0180079 A1 * 7/2011 Krawchuk ..... A41B 13/06 128/873
2011/0231978 A1 * 9/2011 Reid ..... A41D 11/00 2/80
2012/0124722 A1 * 5/2012 Yadav ..... A62B 17/006 2/457
2012/0260393 A1 * 10/2012 Crites ..... A41D 13/012 2/67
2013/0139290 A1 * 6/2013 Barski ..... A41B 13/06 2/69.5
2013/0185841 A1 * 7/2013 Berkowitz ..... A44B 19/301 24/420
2013/0269080 A1 * 10/2013 Parker ..... A41B 13/06 2/69.5
2013/0298304 A1 * 11/2013 Ott ..... A44B 19/24 2/80
2014/0039422 A1 * 2/2014 Scott ..... A41D 13/1263 604/293
2015/0059050 A1 3/2015 Cousin
2017/0224025 A1 * 8/2017 Villarreal ..... A41B 13/06
2018/0042310 A1 * 2/2018 Mortimer ..... A41D 27/00
2018/0049480 A1 * 2/2018 Fay ..... A41D 11/00
2018/0168240 A1 * 6/2018 Parker ..... A41B 13/06
2018/0332902 A1 * 11/2018 Damir ..... A41B 13/06
2019/0208831 A1 * 7/2019 Joshi ..... A41D 15/002

* cited by examiner

CHILDREN'S GARMENT

BACKGROUND OF THE INVENTION

Zippers, particularly on children and infant's garments, are intended to be opened and closed only by a parent or other supervising adult when the zipper is in a closed position. When a zipper is positioned on a garment in a location accessible to the child or infant wearer, undesirable consequences can result if the child or infant accesses the closed zipper and opens the garment.

It is the primary object of the present invention to provide a garment for a child or infant which includes means for preventing the wearer from accessing and opening a closed zipper.

SUMMARY OF THE INVENTION

The present invention is generally directed to clothing for infants, toddlers and children, and in particular, sleeping garments such as pajamas or sleep sacks with zipper closures.

The garment in accordance with the present invention prevents access by the wearer to the zipper when the infant, toddler or child is enclosed within the garment. This is accomplished by providing the garment with positive securing means for maintaining the zipper in a closed position when the infant, toddler or child is wearing the garment and might have access to the zipper. Preferably, the zipper is also located on the garment in a position which cannot be accessed by the wearer.

DESCRIPTION OF THE BEST MODES FOR CARRYING OUT THE INVENTION

Figure 1:
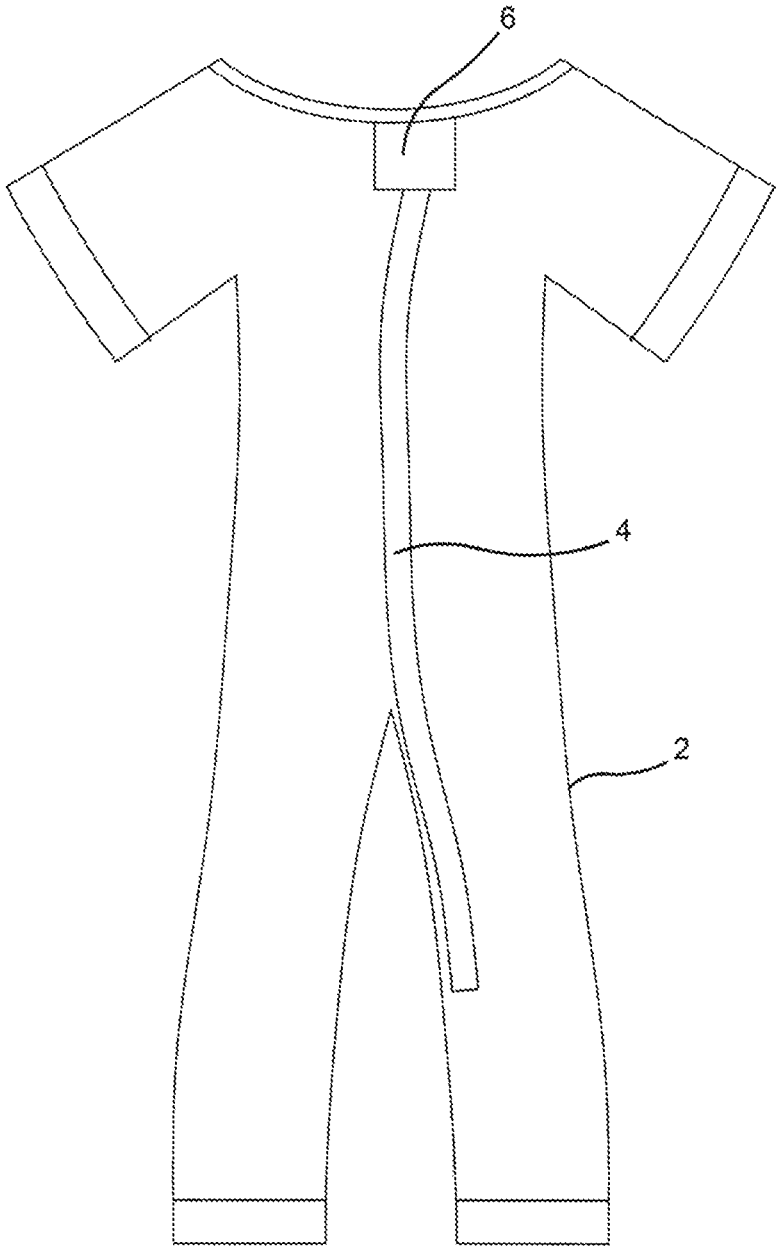
FIG. 1 generally illustrates a child's garment with a closed zipper extending from the main body of the garment to one leg of the garment.

FIG. 1 of the drawing illustrates a rear elevational view of a garment 2 in accordance with the present invention. A substantially full length zipper 4 extends from the top of the rear of the garment, down the center of the back of the garment, and down the rear of one leg portion of the garment. The zipper 4 is provided on the back of the garment, and extends substantially through a large portion of the overall length of the garment, for preventing access to the zipper by the wearer of the garment, when the zipper is in its closed position as illustrated by FIG. 1. A closure structure for maintaining the zipper in its closed position, which is generally designated by reference numeral 6 and which will be discussed in greater detail below, is located at the top of the zipper track proximate to the neck portion at the rear of the garment.

FIG. 1 generally illustrates full body children's pajamas in accordance with the present invention that zip up in the back to prevent removal of clothing by the wearer during sleep. The pajamas have a tight high crew neckline to prevent pulling down over the shoulders by the wearer. There are different pajama styles: short sleeve with shorts, short sleeve with pants, long sleeve with pants, long sleeve with pants and footies. The zipper 4 illustrated by FIG. 1 extends downwardly only part way down the rear of one leg portion of the garment, near the calf, in order to prevent the pajamas from being kicked off the foot by the wearer while being zippered into the garment. Preferably, the garment is made from 100% knit cotton or 100% polyester to meet required flammability standards for sleep wear.

Figure 2:
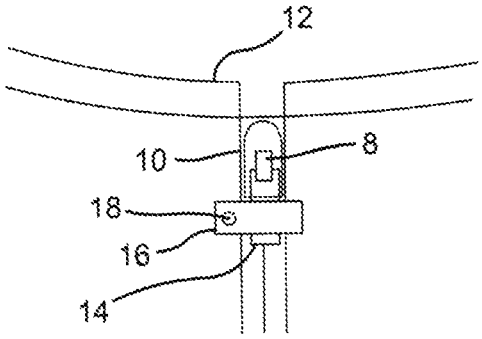
FIG. 2 illustrates a locking device for the zipper slider and the first step in a sequence to secure the zipper slider in a closed position.

FIG. 2 of the drawing illustrates an isolated view of the zipper slider 8 in its uppermost closed position at the top of the zipper track 10 near the collar 12 at the rear of the garment. In this position, the tab 14 of the slider 8 of the zipper is maintained in its closed position by a retaining element such as a first flap portion 16 of the garment inserted underneath the tab 14 of the slider so as to abut against the bottom of the slider 8 of the zipper to prevent the slider from moving downwardly. The flap 16 has a snap 18 which cooperates with a complimentary snap on the garment for selectively opening and closing the flap 16.

Figure 3:
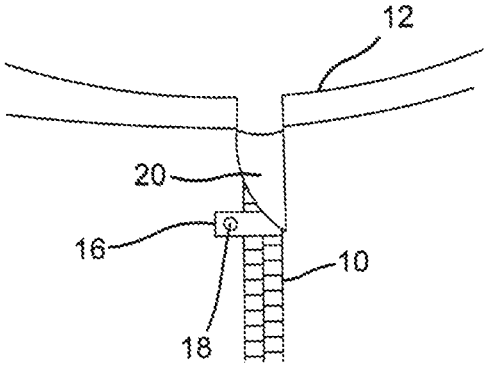
FIG. 3 illustrates the locking device of FIG. 2 in the second step of the sequence to secure the zipper slider in the closed position.

FIG. 3 illustrates a closure element such as a pocket 20 defined in the rear of the garment at the top of the zipper track 10 proximate to the collar 12 of the garment. When the zipper is in its closed position and secured by the flap 16 and the snap 18 as illustrated by FIG. 2, the zipper slider 8, the zipper tab 14, and the flap 16 are all received within the pocket 20.

Figure 4:
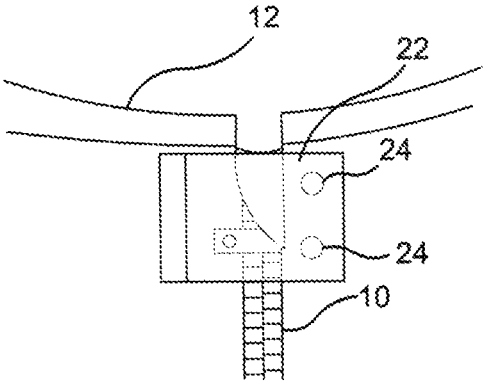
FIG. 4 illustrates the locking device of FIG. 3 in the third and final step of the sequence to secure the zipper slider in the closed position.

FIG. 4 illustrates a second closure element such as a second flap portion 22 defined in the rear portion of the garment at the top of the zipper track 10 proximate to the collar 12 of the garment. When the zipper is secured in its upper closed position by the first flap 16 and snap 18 as illustrated by FIG. 2, and when the zipper is received in the pocket 20 as illustrated by FIG. 3, the second flap portion 22 is snapped closed over the pocket 20 to further secure the zipper in its upper closed position. The second flap 22 is shown as having two snaps 24 which cooperate with two complimentary snaps on the garment for selectively opening and closing the second flap 22.

Figure 5A:
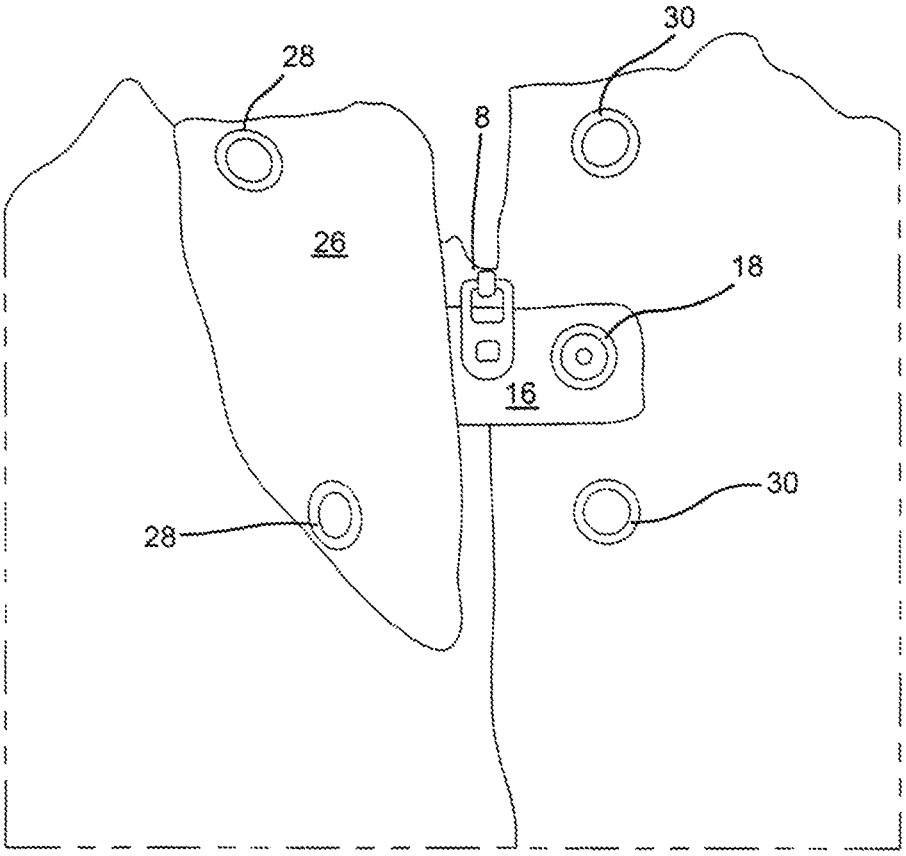
FIGS. 5A and 5B illustrate a slightly modified embodiment of the locking device illustrated by FIGS. 2-4.
Figure 5B:
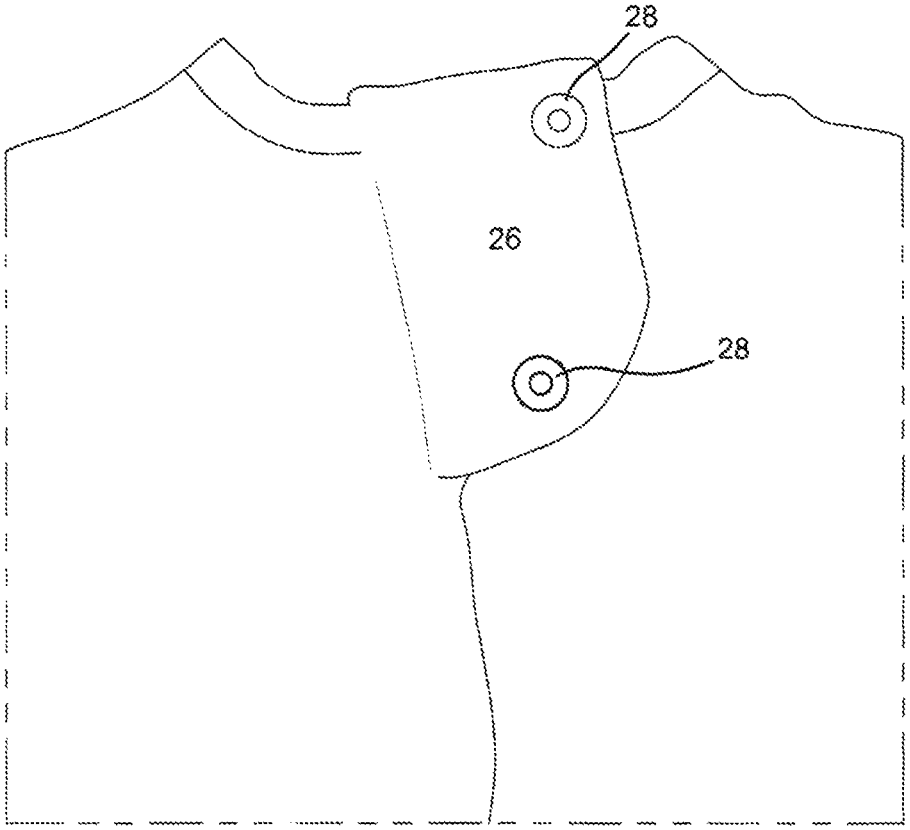

FIGS. 5A and 5B illustrate a modified embodiment of the zipper closure structure illustrated by FIGS. 1-4. In a manner similar to that illustrated by and discussed with respect to FIG. 2, a retainer element 16, such as a tab, is positioned below the slider 8 of the zipper in its closed position, as illustrated by FIG. 5A. The retaining element 16 is fixed in this position relative to the slider by complimentary snaps 18 so that the zipper cannot move and is retained in its fully closed position. Then, instead of proceeding as discussed with respect to FIGS. 3 and 4, a pocket 26 is closed by a complimentary pair of snaps 28, 30 to fully enclose and isolate the retaining element and the zipper therein. In this manner, the zipper is protected and maintained in its fully closed position in two separate ways, namely, by the retaining element preventing the zipper from moving out of its fully closed position, and by the pocket which fully encloses the zipper and its retaining element therein. Thus, even if the pocket 26 is opened by the wearer, the zipper is still maintained in its fully closed position by the retaining element abutting against the lower end of the slider 8 of the zipper to prevent any movement of the zipper.

Although the primary application of the invention is directed to garments and sleepwear for infants, toddlers and young children, it is also applicable to adults and other persons having disabilities or special needs, and can be produced in larger sizes to accommodate such people.

The invention claimed is:

1. A garment having a zipper for selectively opening and closing the garment, said zipper having a slider portion and a tab attached to said slider portion, said garment including a locking device for selectively securing said zipper in a closed position, said locking device comprising a retaining element for selectively retaining the slider portion of the zipper in a closed position, a first closure element for enclosing the zipper and the retaining element therein when the zipper is in said closed position, and a second closure element, wherein said retaining element comprises a tab positioned against the slider portion of the zipper for preventing movement of the zipper when the zipper is in said closed position, wherein the first closure element comprises a pocket fixed to the garment for enclosing said zipper and said retaining element therein when said zipper is in said closed position, and wherein said second closure element is operatively associated with said first closure element to enclose said zipper, said retaining element, and said first closure element therein when said zipper is said closed position.

2. The garment as claimed in claim 1, further including at least one snap on said second closure element and at least one complimentary snap on said garment for selectively opening and closing said first closure element.

3. A method for selectively securing a zipper on a garment in a closed position, said zipper having a slider portion and a tab attached to said slider portion, said method including the steps:

selectively retaining said slider portion of the zipper in a closed position on the garment by positioning a retaining element formed as a tab against said slider portion of said zipper for preventing movement of said slider portion of said zipper when said zipper is in said closed position;

enclosing said zipper and said retaining element in a first closure element formed as a pocket fixed to the garment when said zipper is in said closed position;

enclosing said zipper, said retaining element, and said first closure element in a second closure element when said zipper is in said closed position; and providing at least one snap on said second closure element and at least one complimentary snap on said garment for selectively opening and closing said second closure element.

4. A garment having a zipper for selectively opening and closing the garment, said zipper having a slider portion and a tab attached to said slider portion, said garment including a locking device for selectively securing said zipper in a closed position, said locking device comprising at least three separate retaining elements for selectively retaining the slider portion of the zipper in a closed position, said retaining elements comprising a first enclosure for receiving said zipper in said closed position, a selectively closable retaining tab positioned to engage and slider portion of said zipper to selectively retain said zipper in said closed position, and a second enclosure for receiving said first enclosure, said zipper in said closed position, and said retaining tab.

5. The garment according to claim 4, wherein said locking device comprises at least one snap on said second enclosure for mating with a complementary snap on said surface of said garment.

* * * * *